United States Patent [19]

Saccoccio

[11] Patent Number: 4,756,168

[45] Date of Patent: Jul. 12, 1988

[54] EARRING CONSTRUCTION

[76] Inventor: August J. Saccoccio, 126 Phenix Ave., Cranston, R.I. 02920

[21] Appl. No.: 904,460

[22] Filed: Sep. 8, 1986

[51] Int. Cl.[4] ..... A44C 7/00

[52] U.S. Cl. ..... 63/14.5; 63/14.6 R; 29/160.6; 411/437; 411/523

[58] Field of Search ..... 63/14 D, 14 E, 14 R, 63/14 A; 411/437, 436, 522, 523, 524, 527, 177, 174; 29/160.6, 526 R

[56] References Cited

U.S. PATENT DOCUMENTS

| | | | |
|---|---|---|---|
| 2,236,850 | 4/1941 | Hansman | 411/174 |
| 2,378,684 | 6/1945 | Carlstrom | 411/523 |
| 2,882,702 | 4/1959 | Goldberg | 63/14 E |
| 2,983,180 | 5/1961 | Sygnator | 411/436 |
| 3,176,475 | 4/1965 | Saccoccio | 63/14 D |
| 3,373,645 | 3/1968 | Holton | 411/437 |
| 3,987,644 | 10/1976 | Saccoccio | 63/14 D |
| 4,188,799 | 2/1980 | Saccoccio | 63/14 E |
| 4,285,167 | 8/1981 | Roth | 411/437 |

FOREIGN PATENT DOCUMENTS

| | | | |
|---|---|---|---|
| 889678 | 10/1943 | France | 411/437 |

*Primary Examiner*—Richard J. Johnson

*Attorney, Agent, or Firm*—Robert J. Doherty

[57] ABSTRACT

A nut-like member especially adapted for use with an earring clip in which a threaded screw provides wearing adjustment. The member includes a U-shaped loop through which circular smooth bore openings are disposed in longitudinal alignment. Each opening has a pinched and reformed chordal flat which engages the screw to give thread-like engagement without the expense of providing threaded openings.

10 Claims, 1 Drawing Sheet

EARRING CONSTRUCTION

BACKGROUND AND SUMMARY OF THE INVENTION

This invention relates to an improved device for engaging a screw and has particular utility in an earring clip of the spring pressure type. Earring clips having adjustable contact spacing which use a transversely or longitudinally mounted screw member adapted for axial back and forth movement in relation to the clip portion on which the screw is mounted are generally known. Such earring constructions are shown in the following U.S. patents: U.S. Pat. No. 3,176,475 issued Apr. 6, 1965; U.S. Pat. No. 3,987,644 issued Oct. 26, 1976; and U.S. Pat. No. 4,188,799 issued Feb. 19, 1980. Each of these patents recognizes that in such an earring construction, it would be prohibitively expensive to provide the clip portion of the earring with a threaded opening or a pair of threaded openings through which the screw member is threadably engaged. Accordingly, it has long been recognized that it is desirable to replace or avoid such threaded openings with inexpensive but operable alternatives. Such alternatives which have met with commercial acceptance in the trade are shown by the above three patents. There is, however, a continuing need for an improved alternative to threaded openings since the screw member in each of the constructions described in the above patents can easily be stripped from the clip on which it is mounted.

Accordingly, the primary object of the present invention is to provide a screw member, holding member or mounting in which the screw member is positively and firmly clamped at spaced axial locations but without the need of providing such holding member with screw threads.

A still further object of the present invention is the provision of a non-threaded screw member receptor which has general utility apart from earring clips and which positively engages a threaded member at spaced axial locations and is of low cost yet effective construction.

These and other objects of the present invention are accomplished by a generally U-shaped loop having two opposed leg segments in which a pair of longitudinally aligned generally circular smooth bore openings are provided therein, a screw carried by said loop received through said aligned openings and wherein each of said openings having at least one chordal extending flat having a generally V-shaped running edge, said edge forming a tooth for engagement with the thread of said screw so as to firmly threadably engage said screw at least two longitudinally spaced points therealong.

Other objects, features and advantages of the invention shall become apparent as the description thereof proceeds when considered in connection with the accompanying illustrative drawing.

DESCRIPTION OF THE DRAWING

In the drawing which illustrates the best mode presently contemplated for carrying out the present invention;

FIG. 5*c* is an enlarged view of the reformed portion of the flat shown in FIG. 4*c* whereas

DESCRIPTION OF THE INVENTION

Figure 1:
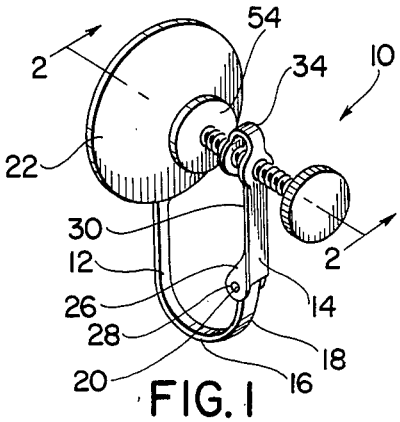
FIG. 1 is a perspective view of an earring clip embodying the present invention.

Referring to the drawing, an earring 10 is shown as comprising a first jaw member 12 and a second jaw member 14. Jaw 12 is of overall J-shaped configuration having a lower curved loop portion 16 adapted to partially encircle a wearer's ear lobe and upwardly extending in a short arm 18 in turn having outwardly extending terminal pintles 20. The other end of the jaw 12 terminates in a generally circular pad or contact member 22 and is provided at an outer portion thereof with an ornament (not shown). The pad or contact member is, as will hereinafter be more apparent, adapted to contact outer portions of the wearer's ear lobe.

The second jaw member 14 terminates at one end in a pair of parallel spaced ears 26 in turn each having an opening 28 provided therethrough for receipt of the pintles 20. A leaf spring 30 is clamped to the jaw member 14 by known means such as bent lugs (not shown). One end of the spring engages end portions of the terminal arm 18 and is, accordingly, operable to maintain the jaw members 12 and 14 in closed position or in an open position wherein the spring 30 contacts that portion of the outer edge of the arm 18 disposed between the pintles 20.

The other end of the jaw member 14 terminates in a generaly U-shaped loop 34 having a first leg segment 36, a second leg segment 38, and a connecting loop or root portion 40. Each of the leg segments 36, 38 is respectively provided with a generally circular opening 42 and 44 respectively. Each such opening is in turn provided with a flat portion 46 and 48 respectively which chordally extends about the inner periphery of the opening and terminates in a pointed edge 52 which in turn is adapted to engage the individual threads of a screw member 53. The relationship between the screw member 53 and the flats 46 and 48 will be hereinafter more fully explained and is a key feature of the present invention in that such relationshp enables the U-shaped loop and the axially-spaced openings therein to function in the manner of a true nut and thus to engage the threaded member 53 in a thread-like manner without the necessity of forming threads in the openings themselves.

The screw member 53 is further provided at one end thereof with a low ear lobe contacting pad 54 and at the other end thereof with a knurled head 56 so as to better able the screw to be turned so as to effect the required axial movement back and forth with respect to the second member 14 so that the spacing between the contacts 22 and 54 may be adjusted to, accordingly, vary the amount of pressure applied to the wearer's ear in the intended manner.

Figure 4A:
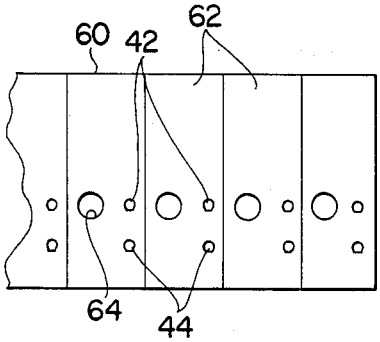
FIGS. 4*a* through 4*e* are views of metal blanks moving through progressive metal forming stations to form the device of the present invention.

The manner in which the above-described flats and the pointed edge 52 thereof are formed and thus the nature of the their construction will now be more fully described with reference to FIGS. 4 and 5 of the drawings. In FIG. 4*a* a metal blank 60 adapted for movement and working in a progressive die is depicted and includes a series of sections 62 each of which will be cut, reshaped and reformed into the loop structure of the present earring ear clip construction. Each blank section 62 is provided with an alignment opening 64 such that the blank may be progressively moved through the sequence of tooling and the opening 42 and 44.

Generally the blank 60 is formed of brass or some other workable metal material which then constitutes the jaw member 14 when appropriately formed and the openings 42 and 44 formed by appropriately shaped dies. It that regard, attention is particularly drawn to FIG. 4*b* where it is evident that each of the openings 42 and 44 is provided with a flat 46 and 48 respectively. Such flats are formed in the die cutting procedure and may preferably be angled such that one portion of the flat is more elevated than the other by a slight angle of say five or seven degrees so as to correspond with the root diameter of the thread of the threaded member 53 (shown in FIG. 4*c*). Thus if the thread of the member 53 includes a pitch of seven degrees then the flat is appropriately pitched an equal amount. The direction of the elevation is dependent on the hand of the thread. This procedure makes for a smoother engagement of the flats 46, 48 with the threads of the threaded member 53.

Figure 4B:
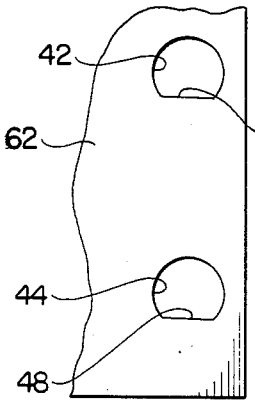
Figure 4C:
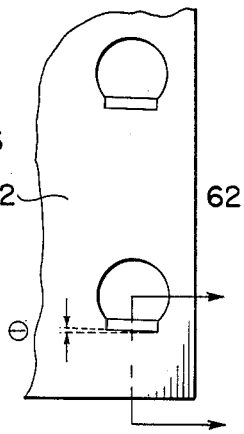
Figure 4D:
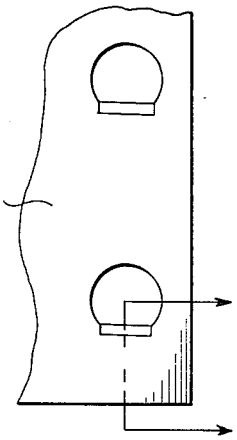
Figure 4E:
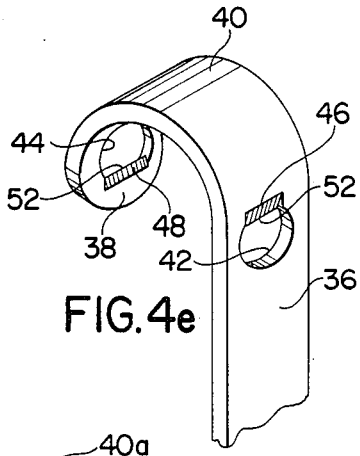
Figure 5C:
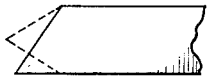

After the blank is die cut as shown in FIG. 4*b*, the flat portion is swedged in a progressive die operation such that the normally straight cut edge of the flats are reformed into a wedge-shaped angle as shown by the solid lines in FIG. 5*c*. Thereafter at a progressive station in the tooling, the pointed edge 52 is then rebent or dapped to position the point of the edge to the dotted line position shown in FIG. 5*c* or to the position shown in solid lines in FIG. 5*d*. This point 53 centered approximately midway in the thickness of the metal forming the blank 60 is the final intended position of the structure. Such rebending or dapping takes place from the opposite side of the blank from which the original swedge was applied. The arm or jaw 26 is then cut from the remainder of the blank segment 62 and reshaped into the loop shown in FIG. 4*c* such that the openings 42 and 44 are axially aligned with each other and ready to receive the threaded member 53 in the intended manner.

Figure 2:
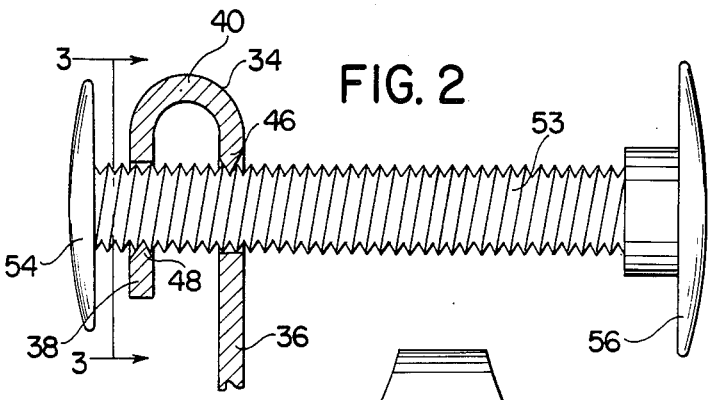
FIG. 2 is an enlarged sectional view of a portion of the earring clip of FIG. 1 taken along the line 2—2 thereof.
Figure 3:
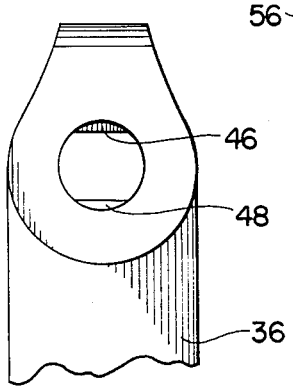
FIG. 3 is a right side elevational view taken along the line 3—3 of FIG. 2.

As best shown by reference to FIGS. 2 and 3, it may be seen that the flats 46 and 48 when reformed into the loop or U-shaped structure are positioned above and below the threaded member 53 such that a desirable contact takes place between individual threads of the threaded member 53 and the flats 46, 48 on opposite sides of the threaded member and at axially spaced areas. This is desirable in that it reduces the tendency of the threaded member to pivot or wobble in the openings. In addition it is preferable that the thickness of the stock is such that the openings 42, 44 will be of such an axial extent that two or more threads contact the smooth bore portions of the opening which aids in the reduction of canting or wobbling of the threaded member therein.

Figure 5D:
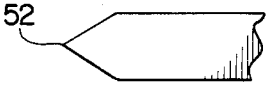
FIG. 5*d* is a similar view but showing the construction of the pointed edge after being reformed.

Accordingly, it may be seen that an inexpensively produced jaw member 26 is produced which acts as a threaded nut for receipt of the member 53 and provides an extremely smooth and strip-free contact operation. Generally it is preferable to shape the running edge 52 of the flat to correspond with the threaded member 53 for which it is intended, that is, if a standard 60 degree thread is utilized, then the included angle of the flat as shown in FIG. 5*d* would also be 60 degrees. That would correspond with a downward swedge of 60 degrees of the flat as shown in FIG. 5*c* and then an upward dapping or reforming of about 30 degrees to provide the final configuration shown in the dotted lines of FIG. 5*c* and in the solid lines in FIG. 5*d*. In addition, it is desirable to provide the axial space between the legs 36 and 38 to correspond with a multiple of the thread interval such that the flats of the thus provided nut structure will freely accept the rotational movement of the threaded member 53. Of course if an exact multiple is not roughly provided, then movement of the threaded member 53 would result in the buildup of an interference fit which in some applications could provide a desirable lock-type nut feature.

Figure 6:
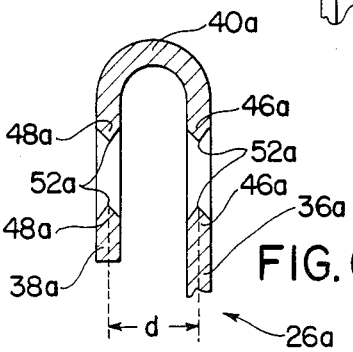
FIG. 6 is a sectional view of a screw fastener embodying the principles of this invention but with opposed flats formed in each of the axially displaced openings.

In that regard, reference is made to FIG. 6 wherein a modified nut structure 26*a* is shown. Therein flats 46*a* and 48*a* are provided on opposite sides of each opening such that a more thread-like structure is provided in that the aforementioned described operations that take place to form the edge 52 in the opposed flats is performed with opposed flats in each opening such that the running edges 52 thereof contact the individual threads of the threaded member 53 both above and below and at spaced axial positions. This gives an even firmer and more thread-like engagement between the nut-like member 26*a* and the threaded member 53. Such a member having more nut-like characteristics could be utilized as a nut substitute in areas other than ear clips and thus would have more general utility.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A clip for earrings and the like comprising first and second jaw members pivotally connected to each other at respective ends thereof, said members movable between open and closed positions thereof and including spring means for urging said members to said closed position, said first jaw member having means at the other end thereof for contacting outer lobe portions of a wearer's ear, said second jaw member terminating at its other end in a generally U-shaped loop having two opposed generally flat, sheet-like leg segments positioned in generally parallel spaced relation to each other, a pair of axially aligned generally circular and smooth bore openings provided in said leg segments, a threaded screw carried by said loop received through said aligned openings, said screw provided at one end thereof with contact means adapted to cooperate with said contact means on said first jaw member and for engaging the opposite side of the ear lobe and at the outer end thereof with means for manually rotating said screw for movement relative to said first jaw member for adjusting the spacing between both of said contact means and, accordingly, the amount of pressure exerted by said clip upon the ear, each of said openings having at least one flat chordally extending across the inner periphery of said openings and entirely within the lateral extent of said leg segments, said flats having a generaly V-shaped running edge, each said edge forming a tooth for engagement with the threads of said screw so as to firmly threadably engage said screw at at least two axially spaced points therealong.

2. The clip construction of claim 1, said running edge disposed generally centrally of the thickness of said flat and having an included angle approximating that of the screw threads.

3. The clip construction of claim 1, said flats disposed on opposite sides of each said opening, said flats of respective openings threadably engaging said screw on opposite sides thereof.

4. The clip of claim 1 wherein said tooth edges engage said threaded member both on opposite sides thereof and at axially spaced points therealong.

5. The clip construction of claim 1, said flats longitudinally angled an amount to approximately equal the thread pitch of the screw.

6. A nut-like member comprising a generally flat elongated element terminating in a generally U-shaped loop having two opposed generally flat sheet-like leg segments positioned in generally parallel, spaced relation to each other, a pair of axially aligned generally circular and smooth bore openings provided in said leg segments, a threaded screw carried by said loop received through said aligned openings, each of said openings having at least one flat chordally extending across the inner periphery of said openings and entirely within the lateral extent of said leg segments, said flats having a generally V-shaped running edge, said edge forming a tooth for engagement with the threads of said screw so as to firmly threadably engage said screw at at least two axially spaced points therealong.

7. The nut-like member of claim 6 wherein said tooth edges engage said threaded member both on opposite sides thereof and at axially spaced points therealong.

8. The nut-like member of claim 6, said running edge disposed generally centrally of the thickness of said flat and having an included angle approximating that of the screw threads.

9. The nut-like member of claim 6, said flats disposed on opposite sides of each said opening, said flats of respective openings threadably engaging said screw on opposite sides thereof.

10. The nut-like member of claim 6, said flats longitudinally angled an amount to approximately equal the thread pitch of the screw.

* * * * *